US010378533B2

(12) United States Patent
Nares et al.

(10) Patent No.: US 10,378,533 B2
(45) Date of Patent: Aug. 13, 2019

(54) CONTROL FOR COMPRESSOR UNLOADING SYSTEM

(71) Applicants: Terry Nares, Syracuse, NY (US); Joseph DuMont Sanchez, Norcross, GA (US); Peter Paul Narreau, Suwanee, GA (US)

(72) Inventors: Terry Nares, Syracuse, NY (US); Joseph DuMont Sanchez, Norcross, GA (US); Peter Paul Narreau, Suwanee, GA (US)

(73) Assignee: BITZER US, Inc., Oakwood, GA (US)

( * ) Notice: Subject to any disclaimer, the term of this patent is extended or adjusted under 35 U.S.C. 154(b) by 1647 days.

(21) Appl. No.: 13/693,900

(22) Filed: Dec. 4, 2012

(65) Prior Publication Data

US 2013/0139535 A1 Jun. 6, 2013

Related U.S. Application Data

(60) Provisional application No. 61/567,174, filed on Dec. 6, 2011.

(51) Int. Cl.
*F04B 49/00* (2006.01)
*F25B 1/02* (2006.01)
(Continued)

(52) U.S. Cl.
CPC ..... *F04B 49/00* (2013.01); *F04B 27/1009* (2013.01); *F04B 27/24* (2013.01);
(Continued)

(58) Field of Classification Search
CPC .. Y10T 137/85986; F04B 49/00; F04B 27/24; F04B 27/1009; F04B 49/06;
(Continued)

(56) References Cited

U.S. PATENT DOCUMENTS 878,562 A 2/1908 Reeve
1,394,802 A 10/1921 Wineman
(Continued)

FOREIGN PATENT DOCUMENTS

CA 1 135 368 11/1982
CN 1109864 C 5/2003
(Continued)

*Primary Examiner* — Charles G Freay
*Assistant Examiner* — Lilya Pekarskaya
(74) *Attorney, Agent, or Firm* — Reinhart Boerner Van Deuren P.C.

(57) ABSTRACT

A variable-capacity compressor that includes a housing having an inlet for receipt of refrigerant and an outlet for return of refrigerant, and a plurality of compressing elements contained in the housing between the inlet and the outlet. The variable capacity compressor includes a valve having an electrical control. The valve is dedicated to fewer than all of the compressing elements. The valve is movable between a first state which communicates refrigerant flow to the compressing elements, and a second state that reduces or stops flow to the compressing elements. In an embodiment of the invention, an unloading controller has an operational modulation mode that includes cycling the valve between on and off states to provide a portion of compressor capacity. The unloading controller is further programmed to provide a minimum delay time between transitions between the first and second states, but no maximum dwell time between transitions.

34 Claims, 4 Drawing Sheets

(51) Int. Cl.

| | |
|---|---|
| ***F04B 27/10*** | (2006.01) |
| ***F04B 27/24*** | (2006.01) |
| ***F04B 39/10*** | (2006.01) |
| ***F04B 49/03*** | (2006.01) |
| ***F04B 49/06*** | (2006.01) |
| ***F25B 49/02*** | (2006.01) |
| *F04B 39/08* | (2006.01) |

(52) U.S. Cl.
CPC ..... *F04B 39/10* (2013.01); *F04B 49/03* (2013.01); *F04B 49/06* (2013.01); *F25B 1/02* (2013.01); *F25B 49/022* (2013.01); *F04B 39/08* (2013.01); *F25B 2400/075* (2013.01); *F25B 2600/0262* (2013.01); *F25B 2600/23* (2013.01); *Y10T 137/85986* (2015.04)

(58) Field of Classification Search
CPC ..... F04B 39/10; F04B 49/03; F25B 49/022; F25B 1/02; F25B 2600/23; F25B 2600/0262; F25B 2400/075
See application file for complete search history.

(56) References Cited

U.S. PATENT DOCUMENTS

| | | | | |
|---|---|---|---|---|
| 1,408,943 | A | 3/1922 | Holdsworth | |
| 1,584,032 | A | 5/1926 | Hoffman | |
| 1,716,533 | A | 6/1929 | Redfield | |
| 1,798,435 | A | 3/1931 | Saharoff | |
| 1,878,326 | A | 9/1932 | Ricardo | |
| 1,984,171 | A | 12/1934 | Baker | |
| 2,134,834 | A | 11/1938 | Nordberg | |
| 2,134,835 | A | 11/1938 | Nordberg | |
| 2,171,286 | A | 8/1939 | Baker | |
| 2,185,473 | A | 1/1940 | Neeson | |
| 2,206,115 | A | 7/1940 | Obreiter, Jr. | |
| 2,302,847 | A | 11/1942 | Ferguson | |
| 2,304,999 | A | 12/1942 | Gonzalez | |
| 2,346,987 | A | 4/1944 | Newton | |
| 2,369,841 | A | 2/1945 | Neeson | |
| 2,412,503 | A | 12/1946 | Gerteis | |
| 2,421,872 | A | 6/1947 | Evelyn | |
| 2,423,677 | A | 7/1947 | Balogh | |
| 2,470,380 | A | 5/1949 | Turnwald | |
| 2,546,613 | A | 3/1951 | Paget | |
| 2,602,582 | A | 7/1952 | Garbaccio | |
| 2,626,099 | A | 1/1953 | Ashley | |
| 2,738,659 | A | 3/1956 | Heed | |
| 2,801,827 | A | 8/1957 | Dolza | |
| 2,982,467 | A | 5/1961 | Corson et al. | |
| 3,280,582 | A | 10/1966 | Knaebel | |
| 3,303,988 | A | 2/1967 | Weatherhead | |
| 3,732,036 | A | 5/1973 | Busbey et al. | |
| 3,790,310 | A | 2/1974 | Whelan | |
| 3,885,938 | A | 5/1975 | Ordonez | |
| 4,025,239 | A | 5/1977 | Richardson, Jr. et al. | |
| RE29,283 | E | 6/1977 | Shaw | |
| RE29,621 | E | 5/1978 | Conley et al. | |
| 4,105,371 | A | 8/1978 | Savage et al. | |
| 4,112,703 | A | 9/1978 | Kountz | |
| 4,152,902 | A | 5/1979 | Lush | |
| 4,184,341 | A | 1/1980 | Friedman | |
| 4,220,197 | A | 9/1980 | Schaefer et al. | |
| 4,249,866 | A | 2/1981 | Shaw et al. | |
| 4,267,702 | A | 5/1981 | Houk | |
| 4,312,626 | A | 1/1982 | Juran | |
| 4,336,001 | A | 6/1982 | Andrew et al. | |
| 4,384,462 | A | 5/1983 | Overman et al. | |
| 4,437,317 | A | 3/1984 | Ibrahim | |
| 4,442,680 | A | 4/1984 | Barbier et al. | |
| 4,447,196 | A | 5/1984 | Nagasaku et al. | |
| 4,452,570 | A | 6/1984 | Fujisaki et al. | |
| 4,452,571 | A | 6/1984 | Koda et al. | |
| 4,506,517 | A | 3/1985 | Pandzik | |
| 4,507,936 | A | 4/1985 | Yoshino | |
| 4,580,947 | A | 4/1986 | Shibata et al. | |
| 4,655,689 | A | 4/1987 | Westveer et al. | |
| 4,679,404 | A | 7/1987 | Alsenz | |
| 4,697,421 | A | 10/1987 | Otobe et al. | |
| 4,727,725 | A | 3/1988 | Nagata et al. | |
| 4,743,168 | A * | 5/1988 | Yannascoli | F04B 49/225 417/287 |
| 4,794,759 | A | 1/1989 | Lyon | |
| 4,838,766 | A | 6/1989 | Kimura et al. | |
| 4,848,101 | A | 7/1989 | Suzuki | |
| 4,878,818 | A | 11/1989 | Shaw | |
| 4,880,356 | A | 11/1989 | Suzuki et al. | |
| 4,893,480 | A | 1/1990 | Matsui et al. | |
| 4,926,652 | A | 5/1990 | Kitamoto | |
| 4,932,220 | A | 6/1990 | Inoue | |
| 4,934,157 | A | 6/1990 | Suzuki et al. | |
| 4,946,350 | A | 8/1990 | Suzuki et al. | |
| 5,027,612 | A | 7/1991 | Terauchi | |
| 5,056,990 | A | 10/1991 | Nakajima | |
| 5,129,791 | A | 7/1992 | Nakajima | |
| 5,191,768 | A | 3/1993 | Fujii | |
| 5,211,026 | A | 5/1993 | Linnert | |
| 5,244,357 | A | 9/1993 | Bauer | |
| 5,263,333 | A | 11/1993 | Kubo et al. | |
| 5,265,434 | A * | 11/1993 | Alsenz | F25B 49/022 62/117 |
| 5,400,609 | A | 3/1995 | Sjoholm et al. | |
| 5,426,952 | A | 6/1995 | Bessler | |
| 5,492,450 | A | 2/1996 | Bearint et al. | |
| 5,600,961 | A * | 2/1997 | Whipple, III | F04B 25/005 417/287 |
| 5,695,325 | A | 12/1997 | Sperry | |
| 5,713,724 | A | 2/1998 | Centers et al. | |
| 5,741,120 | A | 4/1998 | Bass et al. | |
| 5,865,604 | A | 2/1999 | Kawaguchi et al. | |
| 6,047,557 | A | 4/2000 | Pham et al. | |
| 6,077,051 | A | 6/2000 | Centers et al. | |
| 6,148,632 | A | 11/2000 | Kishita et al. | |
| 6,206,652 | B1 | 3/2001 | Caillat | |
| RE40,830 | E | 7/2009 | Caillat | |
| 2002/0157820 | A1* | 10/2002 | Beitelmal | F25B 5/04 165/206 |
| 2006/0218959 | A1* | 10/2006 | Sandkoetter | F04B 49/225 62/324.1 |
| 2007/0144193 | A1 | 6/2007 | Crane et al. | |
| 2009/0217679 | A1* | 9/2009 | Raghavachari | F25B 1/10 62/77 |

FOREIGN PATENT DOCUMENTS

| | | | |
|---|---|---|---|
| CN | 100406732 | C | 7/2008 |
| EP | 0 060 315 | A1 | 9/1982 |
| EP | 0 222 109 | A1 | 5/1987 |
| EP | 0 309 242 | A2 | 3/1989 |
| EP | 0 403 239 | A2 | 12/1990 |
| EP | 0 777 052 | A2 | 6/1997 |
| EP | 0 814 262 | A2 | 12/1997 |
| EP | 0 871 818 | A1 | 10/1998 |
| GB | 551304 | | 2/1943 |
| GB | 654451 | | 6/1951 |
| GB | 762110 | | 11/1956 |
| GB | 889286 | | 2/1962 |
| GB | 1 054 080 | | 1/1967 |
| GB | 1 248 888 | | 10/1971 |
| GB | 2 043 863 | A | 10/1980 |
| GB | 2 247 543 | A | 3/1992 |
| GB | 2 269 246 | A | 2/1994 |
| GB | 2 269 684 | A | 2/1994 |
| JP | 54 064711 | A | 5/1979 |
| JP | 57 200685 | A | 12/1982 |
| JP | 58 195089 | A | 11/1983 |
| JP | 62 029779 | A | 2/1987 |
| JP | 62 125262 | A | 6/1987 |
| JP | 63 205478 | A | 8/1988 |
| JP | 63 138490 | U | 9/1988 |
| JP | 63 266178 | A | 11/1988 |
| JP | 1-200079 | A | 8/1989 |

(56) References Cited

FOREIGN PATENT DOCUMENTS

| | | | |
|---|---|---|---|
| JP | 2-115577 | A | 4/1990 |
| JP | 2-191882 | A | 7/1990 |
| JP | 3-138473 | A | 6/1991 |
| JP | 3-199677 | A | 8/1991 |
| JP | 4-284194 | A | 10/1992 |
| JP | 5-164043 | A | 6/1993 |
| JP | 5-187357 | A | 7/1993 |
| JP | 9-280171 | A | 10/1997 |
| JP | 10-37863 | A | 2/1998 |
| WO | WO 89/10768 | A1 | 11/1989 |
| WO | WO 93/06423 | A1 | 4/1993 |
| WO | WO 99/07683 | A1 | 2/1999 |
| WO | WO 2011/011221 | A2 | 1/2011 |

* cited by examiner

CONTROL FOR COMPRESSOR UNLOADING SYSTEM

CROSS-REFERENCE TO RELATED PATENT APPLICATIONS

This patent application claims the benefit of U.S. Provisional Patent Application No. 61/567,174 filed Dec. 6, 2011, the entire teachings and disclosure of which are incorporated herein by reference thereto.

FIELD OF THE INVENTION

This invention generally relates to system for modulating the capacity of a compressor or group of compressors.

BACKGROUND OF THE INVENTION

Refrigeration systems, particularly commercial and industrial refrigeration systems, may have a single compressor though these systems often include a number of refrigerant compressors. Typically, there are enough compressors to accommodate the anticipated peak load to be placed on the refrigeration system. However, most refrigeration systems operate at peak load for only a few hours out of the year and spend most of the time operating at a load point less then the peak design load. As such, it is desirable to be able to modulate the capacity of the refrigeration system to save energy and reduce operating costs when the load on the refrigeration system decreases.

In other conventional refrigeration systems, the compressors are unloaded using a gas bypass system. In a gas bypass system, compressed refrigerant is recirculated from the discharge side of the compressor back to the suction side of the compressor. However, with this method of compressor unloading, the energy expended to compress the refrigerant is wasted each cycle that the refrigerant is recirculated back to the suction side of the compressor, thus reducing overall system efficiency. As a result, maintaining and operating the types of conventional refrigeration systems described above can be costly.

Embodiments of the invention represent an improvement in the state of the art for single-compressor and multiple-compressor refrigeration systems. These and other advantages of the invention, as well as additional inventive features, will be apparent from the description of the invention provided herein.

BRIEF SUMMARY OF THE INVENTION

In one aspect, embodiments of the invention provide a variable-capacity compressor that includes a housing having an inlet for receipt of refrigerant and an outlet for return of refrigerant, and a plurality of compressing elements contained in the housing between the inlet and the outlet. The compressor further includes at least one valve having an electrical control. Each valve is dedicated to selected compressing elements that are fewer than all of the plurality of compressing elements. Also, each valve is movable between a first state in which the at least one valve is open to communicate refrigerant flow to the compressing elements, and a second closed state in which the at least one valve is closed to reduce or stop flow to the compressing elements relative to the first open state. The unloading controller is programmed to implement an operational modulation mode to cycle the at least one valve between on and off states to provide a portion of capacity represented by the at least one valve's corresponding compressing elements. In a particular embodiment of the invention, the unloading controller is programmed to provide a minimum delay time between transitions between the first and second states, but no maximum dwell time between transitions. In a more particular embodiment, the minimum delay time ranges from 5 to 40 seconds.

In an embodiment, the at least one valve comprises a plunger and a solenoid configured to control movement of the plunger. In a more particular embodiment, the plunger is located in a flow path between a discharge chamber of the compressor and a suction chamber of the compressor. In a further embodiment, the at least one valve is configured to control the flow of refrigerant to a single compressing element. In yet another embodiment, the at least one valve is configured to control the flow of refrigerant to a pair of compressing elements. The variable-capacity compressor may include a plurality of valves, each controlled by the unloading controller. The unloading controller may be programmed to provide a minimum dwell time for the analog control signal, such that transitions between the first and second states only occur when the analog control signal, after crossing a threshold voltage or current level, does not cross the threshold level again for the minimum dwell time. In particular embodiments, the minimum dwell time ranges from three to seven seconds. Further, the unloading controller may be programmed to reset a clock each time the analog control signal crosses the threshold voltage or current level.

In certain embodiments, the commands from the refrigeration system controller are transmitted in the form of an analog control signal, and wherein transitions between the first and second states are determined by the analog control signal. In particular embodiments, the variable-capacity compressor has a desired operating condition, wherein the unloading controller, in response to the analog control signal, is programmed to vary, without limit, the amount of time the at least one valve dwells in the first or second state in order for the variable-capacity compressor to reach the desired operating condition.

In one embodiment, the unloading controller comprises a programmable logic controller (PLC) programmed to energize the solenoid in response to analog control signals from the refrigeration system controller. In certain embodiments, a voltage level or a current level of the analog control signal has a predetermined range, and the at least one valve is commanded to change states based on variations in the voltage level or the current level of the analog control signal.

In a particular embodiment of the invention, the voltage level of the analog control signal ranges from a minimum voltage to a maximum voltage. In a more particular embodiment, the unloading controller is programmed to cause the at least one valve to dwell in, or cycle to, one of the first and second states when the voltage level of the analog control signal is less than a threshold low voltage, and to cause the at least one valve to dwell in, or cycle to, the other of the first and second states when the voltage level of the analog control signal is greater than a threshold high voltage, where the threshold high voltage is greater than the threshold low voltage, and where the threshold low voltage and the threshold high voltage are both greater than the minimum voltage, and both are less than the maximum voltage. In some embodiments, the at least one valve does not change its state when the voltage level of the analog control signal is between the threshold low voltage and the threshold high voltage.

In certain embodiments, when the voltage level of the analog control signal is between the low threshold voltage and the high threshold voltage, the unloading controller is programmed to cause the at least one valve to change states based on a rate of change in the voltage level or current level of the analog control signal. In some embodiments, when the voltage level of the analog control signal is between the low threshold voltage and the high threshold voltage, the unloading controller is programmed to cause the at least one valve to remain closed or cycle from open to closed when the voltage level or current level of the analog control signal drops by a predetermined amount within a predetermined time period, and to cause the at least one valve to remain open or cycle from closed to open when the voltage level or current level of the analog control signal rises by the predetermined amount within the predetermined time period.

In a further embodiment, the current level of the analog control signal ranges from a minimum current to a maximum current. In a more particular embodiment, the unloading controller is programmed such that the at least one valve dwells in one of the first and second states when the current level of the analog control signal is less than a threshold low current, and dwells in the other of the first and second states when the current level of the analog control signal is greater than a threshold high current, where the threshold high current is greater than the threshold low current, and where the threshold low current and the threshold high current are both greater than the minimum current, and both are less than the maximum current. In some embodiments, the at least one valve does not change its state when the current level of the analog control signal is between the threshold low current and the threshold high current.

In a particular embodiment, the variable-capacity compressor further comprises a second valve, which, in combination with the at least one valve, controls a flow of refrigerant to fewer than all of the plurality of compressing elements. In yet another particular embodiment, the variable-capacity compressor further comprises a third control valve, which, in combination with the first and second control valves, controls a flow of gas to fewer than all of the plurality of compressing elements.

In another aspect, embodiments of the invention provide a refrigeration system that includes a refrigeration circuit with an evaporator and a condenser. The refrigeration system further includes a plurality of refrigerant compressors configured to circulate refrigerant through the refrigeration circuit. In a particular embodiment, the plurality of refrigerant compressors includes a trim compressor with a plurality of cylinders. The flow of refrigerant to the trim compressor can be modulated to vary the capacity of the refrigeration system. Refrigerant is compressed in each of the plurality of cylinders. In this embodiment, the trim compressor also includes at least one control valve for regulating a flow of refrigerant to fewer than all of the plurality of cylinders. Further, the at least one control valve is configured to transition between open and closed positions, and is located in a cylinder head of the trim compressor. The refrigeration system also includes a refrigeration system controller, which regulates a rate of total refrigerant output from the plurality of compressors. Further, the refrigeration system includes a variable unloading controller configured to receive a first control signal from the refrigeration system controller. The variable unloading controller is also configured to transmit a second control signal to the at least one control valve to vary a rate of refrigerant output from the trim compressor.

In one embodiment, the trim compressor includes a plurality of control valves configured to regulate the flow of refrigerant to fewer than all of the plurality of cylinders. In a particular embodiment, the trim compressor includes six cylinders and further includes either one or two control valves. In yet another particular embodiment, the trim compressor includes eight cylinders and further includes either two or three control valves.

In a particular embodiment of the invention, the control signal from the refrigeration system controller is an analog control signal which varies according to the load placed on the refrigeration system, and the variable unloading controller is programmed to provide a minimum delay time between transitions between the open and closed positions, but no maximum dwell time between transitions. In a more particular embodiment, the minimum delay time ranges from 10 to 30 seconds.

In a further embodiment, the refrigeration system further comprises a second trim compressor having a second variable unloading controller and at least one control valve located in a cylinder head of the second trim compressor, wherein the second variable unloading controller is configured to transmit a third control signal to the at least one control valve for the second trim compressor to vary a rate of refrigerant output from the second trim compressor. In a more particular embodiment, the variable unloading controller and the second variable unloading controller are configured to operate independently of each other.

In a particular embodiment of the invention, the voltage level of the analog control signal ranges from a minimum voltage to a maximum voltage. In a more particular embodiment, the unloading controller is programmed to cause the at least one valve to dwell in, or cycle to, one of the open and closed positions when the voltage level of the analog control signal is less than four volts, and to cause the at least one valve to dwell in, or cycle to, the other of the open and closed positions when the voltage level of the analog control signal is greater than six volts.

In an alternate embodiment, the current level of the analog control signal ranges from a minimum current to a maximum current. In a more particular embodiment, the unloading controller is programmed such that the at least one valve dwells in one of the open and closed positions when the current level of the analog control signal is less than a threshold low current, and dwells in the other of the open and closed positions when the current level of the analog control signal is greater than a threshold high current.

In a further embodiment, the at least one control valve comprises a plunger and a solenoid configured to control movement of the plunger. In a more particular embodiment, the variable unloading controller comprises a PLC controller programmed to energize the solenoid in response to the analog control signals from the refrigeration system controller.

In particular embodiments of the refrigeration system, a voltage level or a current level of the analog control signal varies within a predetermined range, and the at least one control valve is commanded to change states based on variations in the voltage level or the current level of the analog control signal. In certain embodiments, the voltage level of the analog control signal ranges from a minimum voltage to a maximum voltage, and the variable unloading controller is programmed to cause the at least one control valve to dwell in, or cycle to, one of the open and closed positions when the voltage level of the analog control signal is less than a threshold low voltage, and to cause the at least one control valve to dwell in, or cycle to, the other of the open and closed positions when the voltage level of the analog control signal is greater than a threshold high voltage.

In these cases, the threshold high voltage is greater than the threshold low voltage, and the threshold high voltage and the threshold low voltage are both greater than the minimum voltage, and both are less than the maximum voltage. In embodiments of the invention, the current level of the analog control signal ranges from a minimum current to a maximum current, and the variable unloading controller is programmed to cause the at least one control valve to dwell in, or cycle to, one of the open and closed positions when the current level of the analog control signal is less than a threshold low current, and to cause the at least one control valve to dwell in, or cycle to, the other of the open and closed positions when the current level of the analog control signal is greater than a threshold high current. In these embodiments, the threshold high current is greater than the threshold low current, and the threshold high current and the threshold low current are both greater than the minimum current, less than the maximum current.

In certain aspects, the unloading controller is programmed to cause the at least one control valve to dwell in, or cycle to, one of the first and second states when the voltage level of the analog control signal is less than a threshold low voltage, and cause the at least one control valve to dwell in, or cycle to, the other of the first and second states when the voltage level of the analog control signal is greater than a threshold high voltage. When the voltage level of the analog control signal is between the low threshold voltage and the high threshold voltage, the unloading controller is programmed to cause the at least one control valve to change states based on a rate of change in the voltage level or current level of the analog control signal.

In a particular embodiment, when the voltage level of the analog control signal is between the low threshold voltage and the high threshold voltage, the unloading controller is programmed to cause the at least one control valve to remain closed, or cycle from open to closed, when the voltage level or current level of the analog control signal drops by a predetermined amount within a predetermined time period, and to cause the at least one control valve to remain open, or cycle from closed to open, when the voltage level or current level of the analog control signal rises by the predetermined amount within the predetermined time period.

In yet another aspect, embodiments of the invention provide a method of modulating refrigerant flow in a variable-capacity compressor that includes inletting refrigerant into the compressor, which has a plurality of compressor elements, and separately controlling the flow to different sets of compressor elements with a plurality of dedicated valves. In an embodiment, the method also includes controlling the dedicated valves independently of each other between open and closed positions.

In a particular embodiment, separately controlling flow to different sets of compressor elements with a plurality of dedicated valves comprises separately controlling flow to different sets of compressor elements with a plurality of dedicated valves, wherein the different sets of compressor elements comprises fewer than all of the plurality of compressor elements. In a further embodiment, separately controlling flow to different sets of compressor elements with a plurality of dedicated valves comprises separately controlling flow to different sets of compressor elements with a plurality of dedicated solenoid valves.

In a further embodiment, controlling the dedicated valves independently of each other comprises controlling the dedicated valves independently of each other via a variable unloading controller electrically coupled to each of the dedicated valves.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following detailed description describes embodiments of the invention as applied in a refrigeration system. However, one of ordinary skill in the art will recognize that the invention is not necessarily limited to refrigeration systems. Embodiments of the invention may also find use in other systems where compressors are used to supply a flow of compressed gas.

As will be shown below, the demand placed on a refrigeration system may vary with the load placed on the refrigeration system. One way the efficiency of refrigeration systems is increased involves modulating the capacity of the refrigeration system, that is, adjusting the output of the refrigeration system in response to changes in demand. Embodiments of the present invention provide a system for modulating the capacity of a refrigeration system which can be implemented without customized components, and further can be used to retrofit existing refrigeration systems to reduce the cost of operating these systems.

Figure 1:
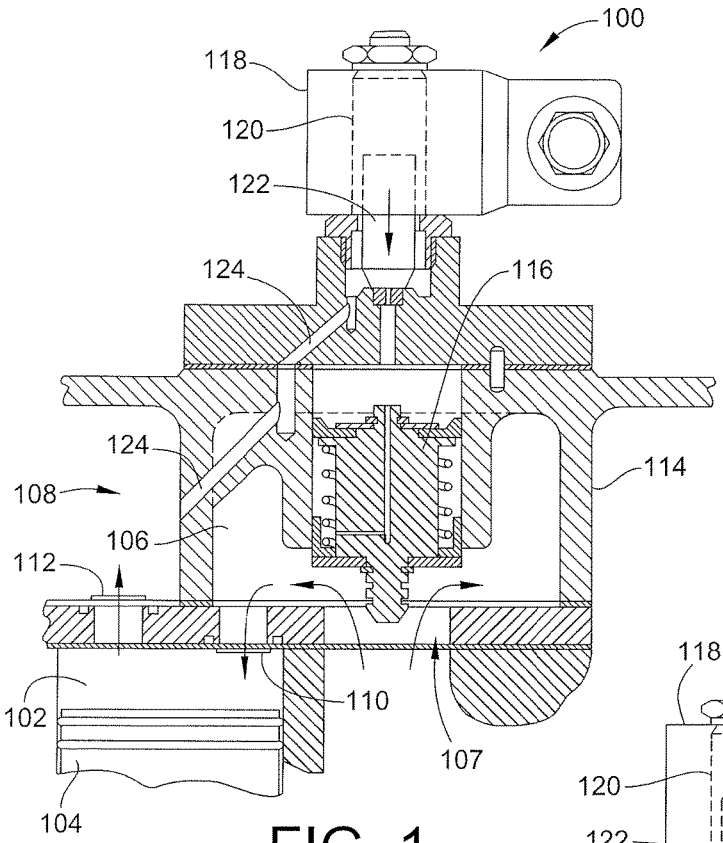
FIG. 1 is a cross-sectional view of a compressor operating in a fully loaded condition, in accordance with an embodiment of the invention.

A system for unloading a compressor, i.e., reducing the flow of compressed gas from the compressor, is shown in FIG. 1, according to an embodiment of the invention. FIG. 1 shows a cross-sectional view of a compressor 100, such as would be used in a refrigeration system, operating in a full-load condition. By "full-load" condition, it is meant that the compressor 100 is operating without any restriction on the flow of refrigerant into the compressor 100. The compressor 100 is a reciprocating piston-type compressor having a compressing element that includes a cylinder 102 with a piston 104 for the compression of a gas, such as those used in refrigeration systems. However, one of ordinary skill in the art will recognize that embodiments of the invention can be used with compressors other than piston-type compressors. The compressor 100 further includes suction chamber 106, having an inlet 107, and discharge chamber 108. There is an inlet valve 110 in the flow path from the suction chamber 106 to the cylinder 102, and an outlet valve 112 in the flow path from the cylinder 102 to the discharge chamber 108.

Figure 2:
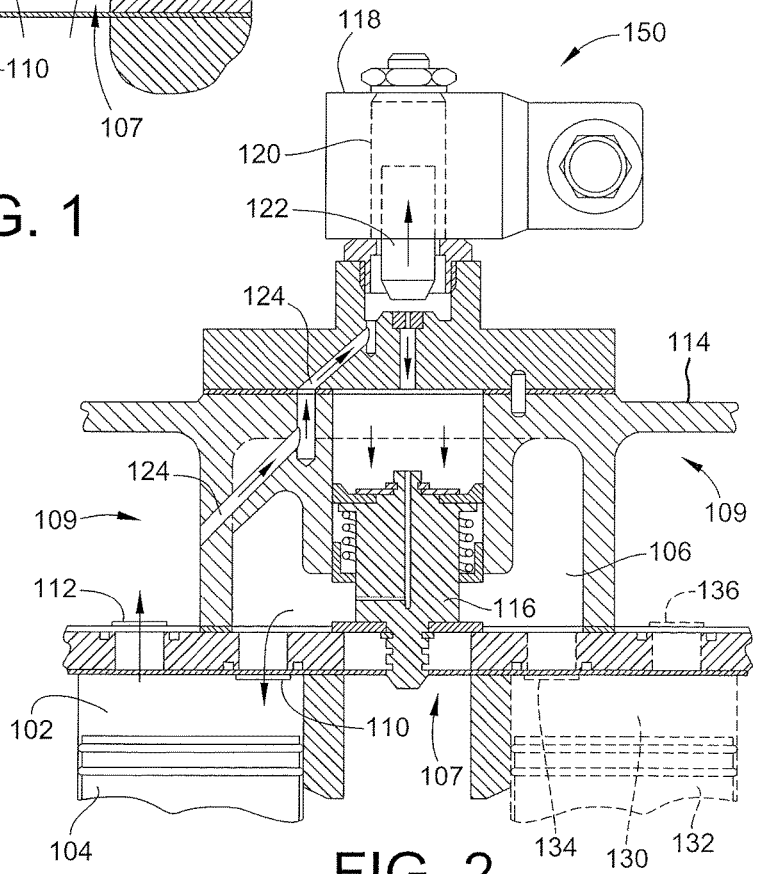
FIG. 2 is a cross-sectional view of a compressor, constructed in accordance with an embodiment of the invention, operating in an unloaded condition.

A cylinder head 114, located above the cylinder 102, defines a substantial portion of the suction chamber 106 and further houses a plunger 116 at least partially disposed in the suction chamber 106 and configured to regulate or stop the flow of gas into the suction chamber 106. In an embodiment of the invention, an upper portion of the cylinder head 114 includes a control valve 118. In the embodiments of FIGS. 1 and 2, the control valve 118 is a solenoid valve having a coil 120 and an armature 122. While other types of control valves 118 are envisioned, in the examples and embodiments described below, the control valve 118 will be referred to as a solenoid valve of the type depicted in FIGS. 1 and 2. Further, the terms "control valve" and "solenoid valve" are used interchangeably in the text below. The armature 122 is disposed in a flow path of a discharge gas port 124 that runs through the cylinder head 114 from the discharge chamber 108 to the plunger 116.

In a particular embodiment of the invention, during operation of the compressor 100 at full-load, refrigerant flows into the suction chamber 106, and from the suction chamber into the cylinder 102 through inlet valve 110. The refrigerant is compressed in cylinder 102 by piston 104 and then flows into discharge chamber 108 through outlet valve 112. In at least one embodiment, the solenoid valve 118 is de-energized during operation at full-load. The armature 122 includes a biasing element (not shown), a spring for example, such that when the solenoid is de-energized, the armature 122 is extended downward by the biasing element, relative to the orientation of FIG. 1. In this downward position, the armature 122 blocks the flow path of the discharge gas port 124. With the flow path blocked, the plunger 116 remains in its upward position, relative to the orientation of FIG. 1, thus allowing refrigerant to flow continuously into the suction chamber 106.

FIG. 2 illustrates a cross-sectional view of the compressor 150 with the compressing element of FIG. 1 including cylinder 102 and piston 104, wherein the compressor 150 is operating in the unloaded condition. Unloading of the compressor 150 occurs when the solenoid valve 118 is energized causing the armature 122 to move against the biasing element (not shown) in the upward direction, relative to the orientation of FIG. 1. This upward movement of the armature 122 allows refrigerant in a discharge chamber 109 to flow through the discharge gas port 124 past the armature 122 to the plunger 116.

Typically, refrigerant in the discharge chamber 109 has been compressed, and is at a higher pressure than refrigerant in the suction chamber 106. The higher pressure refrigerant from the discharge chamber 109 via the discharge gas port 124 exerts a downward force on the plunger 116 causing it to block the inlet 107 to the suction chamber 106. Without the flow of refrigerant into the suction chamber 106, there will be no refrigerant flow from cylinder 102. Thus, in an embodiment of the invention, unloading of the compressor 150 occurs when the plunger blocks the flow of refrigerant into the suction chamber for a particular cylinder, or pair of cylinders. In particular embodiments, the reciprocating piston 104 will continue to run even though no refrigerant flows into the cylinder 102. In alternate embodiments of the invention, a valve other than a solenoid valve can be used to unload the compressor. Further, the plunger for such a valve may be actuated using mechanical means rather than by the refrigerant gas.

It is envisioned that the compressors 100, 150 of FIGS. 1 and 2, and other compressors employed in embodiments of the present invention, are multiple-cylinder reciprocating piston-type compressors. As such, in these multiple-cylinder compressors 100, 150, while one compressing element may include cylinder 102 that is not being supplied with refrigerant (i.e., unloaded), there will be other compressing elements with cylinders in the compressor 100, 150 which will be supplied with refrigerant. Further, in an embodiment of the invention, the plunger 116 may be configured to regulate the flow of refrigerant to two adjacent cylinders.

However, embodiments of the invention feature systems for unloading of the compressor 100, 150 where the unloading apparatus (i.e., solenoid valve 118 and plunger 116) is configured to regulate the flow of refrigerant to fewer than all of the cylinders in the compressor 100, 150. As such, there is always some flow of refrigerant to cylinders of the compressor 100, 150 which do not have a solenoid valve 118 and plunger 116 to block the flow of refrigerant to the suction chamber for that cylinder. During unloading of the compressor 100, 150, this helps prevent overheating because the flow of refrigerant provides a cooling effect to counteract the heat generated by those pistons and cylinders in the compressor 100, 150 operating with a reduced flow of refrigerant.

In a particular embodiment, the compressor 150 of FIG. 2 includes a cylinder head 114 housing a plunger that regulates the flow of refrigerant to cylinder 102, as in FIG. 1, and also to a second cylinder 130 (shown in phantom) having a second piston 132 (shown in phantom). Refrigerant flows into the second cylinder 130 from the suction chamber 106 via a second inlet valve 134 (shown in phantom), and, once compressed, flows from the second cylinder 130 into the discharge chamber 109 via a second outlet valve 136 (shown in phantom).

Figure 3:
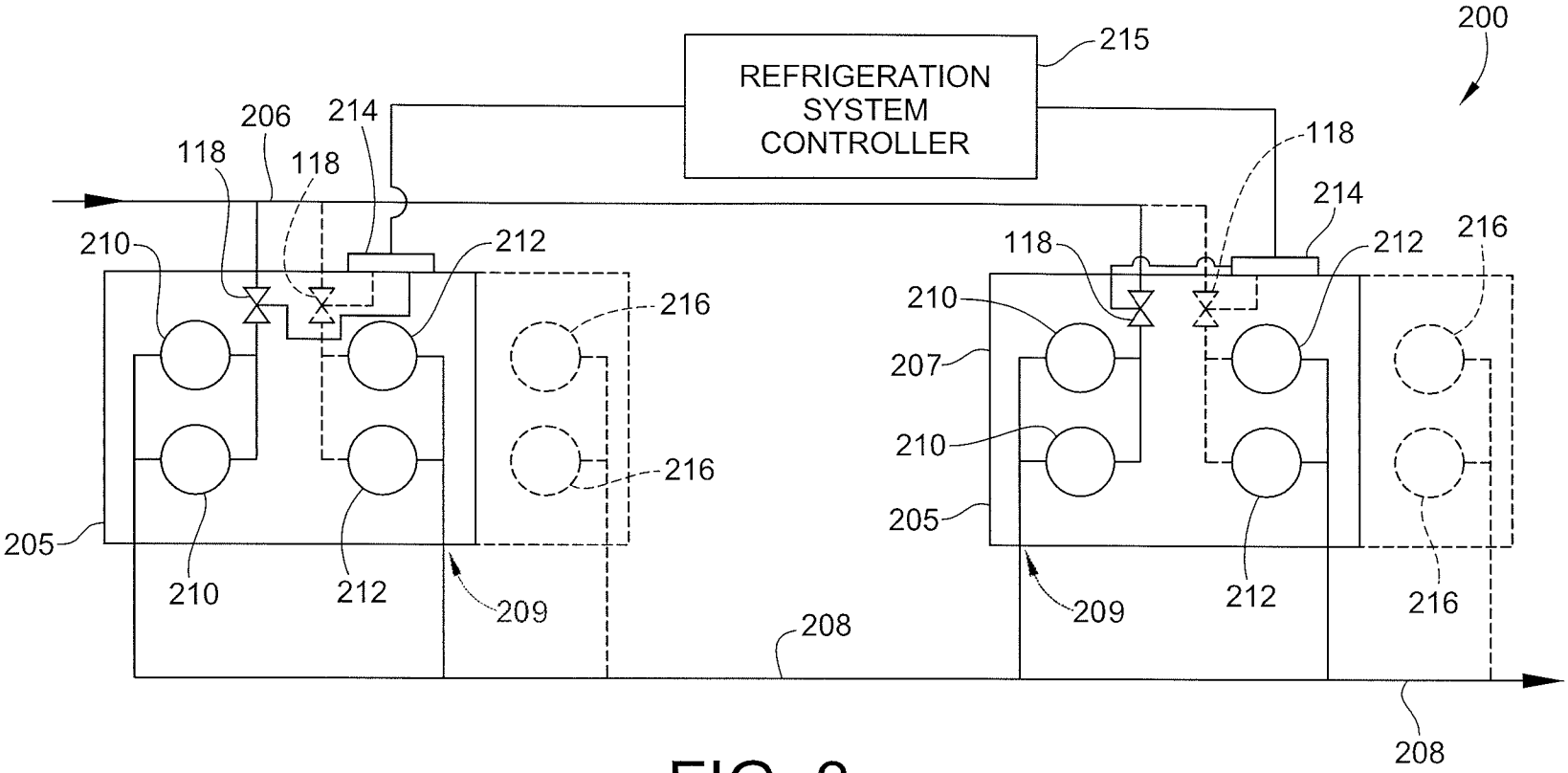
FIG. 3 is a schematic diagram of a refrigeration system having multiple-cylinder compressor, constructed in accordance with an embodiment of the invention.

For example, a common multiple-cylinder compressor is one having four cylinders. FIG. 3 provides a schematic illustration of an exemplary refrigeration system 200 having two compressors 205 with housings 207, each with four cylinders 210, 212, and input flow line 206 configured to supply the two compressors 205 compressor with refrigerant, and an output flow line 208, from one or more outlets 209, configured to carry compressed refrigerant away from the compressors 205. However, the principles described herein with respect to the refrigeration system 200 of FIG. 3, and the system of FIG. 4, apply equally as well in refrigeration systems having more than two compressors. In the example of FIG. 3, each compressor 205 includes a variable unloading controller 214 configured to regulate the control valve 118. Both variable unloading controllers 214 are electrically coupled to the refrigeration system controller 215.

In the embodiment of FIG. 3, each four-cylinder compressor 205 includes control valve 118, which may be a solenoid valve, electrically coupled to the variable unloading controller 214 and further includes plunger 116 (shown in FIG. 1) configured to regulate the flow of refrigerant to two cylinders 210 of the compressor 205, as illustrated in FIG. 3. Thus, during unloading of the compressor 205 via the variable unloading controller 214, refrigerant flows uninterrupted to two cylinders 212. In this embodiment, the four-cylinder compressor 205 can operate in two modes: at 100% capacity in the full-load condition; or anywhere between 50% and 100% capacity in the unloaded condition. It is also envisioned that a refrigeration systems could employ two-cylinder or three-cylinder compressors, in which the solenoid valve 118 and plunger 116 regulate flow to one cylinder, as illustrated in FIG. 1. But, it is also possible that a four-cylinder compressor could have one or more solenoid valves 118 and plungers 116 that each regulate flow to one cylinder of the compressor.

Six-cylinder and eight-cylinder compressors are also fairly commonplace in refrigeration systems. FIG. 3 also shows the refrigeration system 200 with compressors 205 having fifth and sixth cylinders 216 (shown in phantom). According to embodiments of the invention, a six-cylinder compressor could have either one or two solenoid valves 118 and plungers 116 that each regulate flow to two of the six cylinders. FIG. 3 also illustrates a particular embodiment in which the six-cylinder compressors 205 include a second control valve 118 (shown in phantom), which may be a solenoid valve, configured to regulate the flow of refrigerant to two cylinders 212.

The six-cylinder compressor 205 with one solenoid valve 118 and one plunger 116 (shown in FIG. 1) would have refrigerant flowing uninterrupted to four cylinders 212, 216 of the six cylinder during unloading of the compressor. Thus configured, the six-cylinder compressor 205 could operate in two modes: at 100% capacity in the full-load condition; or between 67% and 100% capacity in the unloaded condition. The six-cylinder compressor 205 with two solenoid valves 118 and plungers 116 that each regulate flow to two of the six cylinders would have uninterrupted flow of refrigerant to two cylinders 216, and would have three modes of operation: at 100% capacity in the full-load condition; anywhere between 67% and 100% capacity with only one solenoid valve 118 and plunger 116 unloading the compressor; or anywhere between 33% and 100% capacity with both solenoid valves 118 and plungers 116 unloading the compressor. However, one of ordinary skill in the art would recognize that it is possible to construct a six-cylinder compressor in accordance with embodiments of the invention, wherein the compressor has anywhere from one to five solenoid valves 118 and plungers 116 that each regulate flow to one cylinder of the six-cylinder compressor.

The arrangement shown in FIG. 3 can also be applied in systems having eight-cylinder compressors. In accordance with that described above, an eight-cylinder compressor could have either one, two or three solenoid valves 118 and plungers 116 (shown in FIG. 1) that each regulate flow to two of the eight cylinders. With one solenoid valve 118 and plunger 116, the eight-cylinder compressor could operate in two modes: at 100% capacity in the full-load condition; or at anywhere between 75% and 100% capacity in the unloaded condition.

With two solenoid valves 118 and plungers 116, the eight-cylinder compressor could operate in three modes: at 100% capacity in the full-load condition; at anywhere between 75% and 100% capacity with only one solenoid valve 118 and plunger 116 unloading the compressor; or at anywhere between 50% and 100% capacity with both solenoid valves 118 and plungers 116 unloading the compressor.

With three solenoid valves 118 and plungers 116, the eight-cylinder compressor could operate in four modes: at 100% capacity in the full-load condition; at anywhere between 75% and 100% capacity with only one solenoid valve 118 and plunger 116 unloading the compressor; at anywhere between 50% and 100% capacity with two solenoid valves 118 and plungers 116 unloading the compressor; or at anywhere between 25% and 100% capacity with all three solenoid valves 118 and plungers 116 unloading the compressor.

However, one of ordinary skill in the art would recognize that it is possible to construct a eight-cylinder compressor in accordance with embodiments of the invention, wherein the compressor has anywhere from one to seven solenoid valves 118 and plungers 116 that each regulate flow to one cylinder of the eight-cylinder compressor. Further, one of ordinary skill in the art will recognize that embodiments of the invention described herein may be used with compressors having any number of cylinders and pistons.

Figure 4:
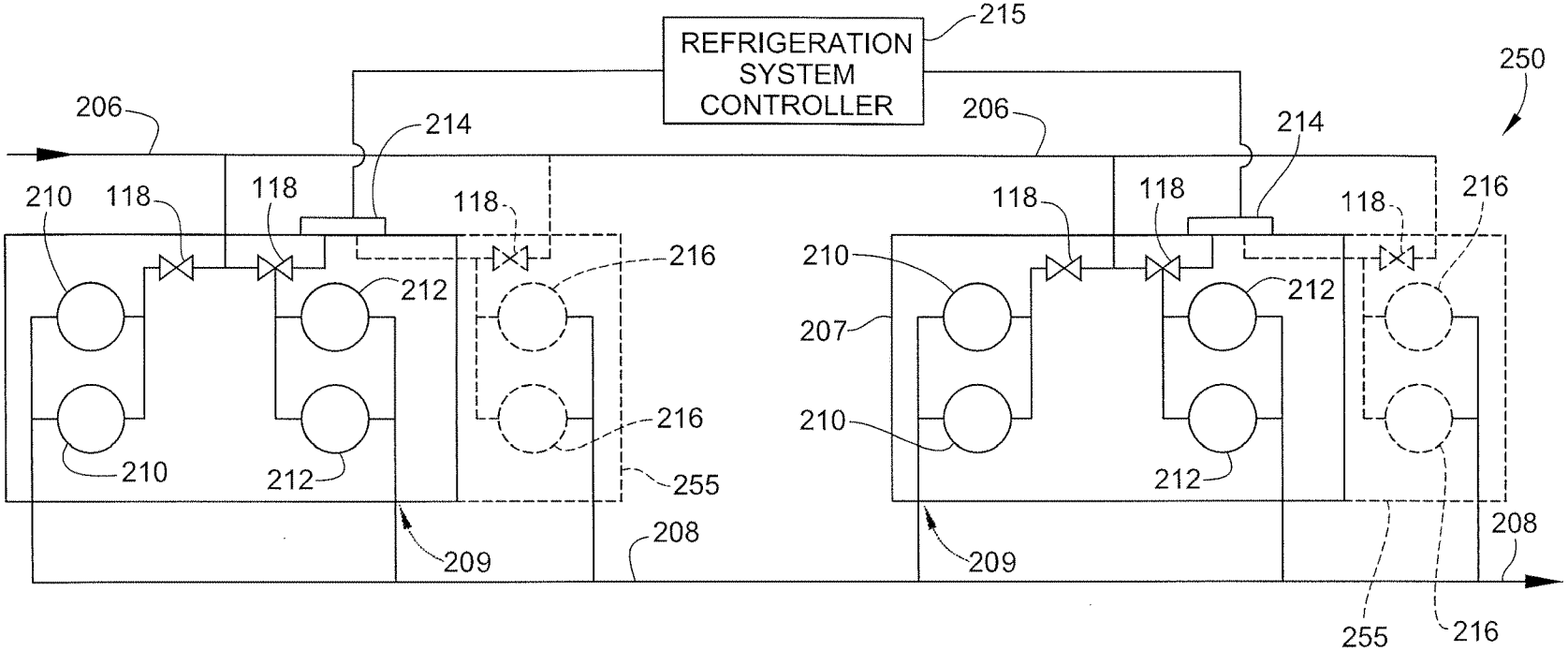
FIG. 4 is a schematic diagram of a refrigeration system having multiple-cylinder compressor, constructed in accordance with an alternate embodiment of the invention.

An alternate embodiment of the invention, illustrated in FIG. 4, provides for a refrigeration system 250 with two four-cylinder compressors 255, an input flow line 206 and output flow line 208. As stated above, the principles of operation described herein also apply to refrigeration systems having more than two compressors. Refrigeration system 250 is similar to the refrigeration system 200, shown in FIG. 3, except that compressors 255 each include two control valves 118 and plungers 116 (shown in FIG. 1), which may be solenoid valves coupled electrically to the variable unloading controller 214, configured to regulate the flow of refrigerant to all of the cylinders in the compressor 255. In the particular embodiment of the invention shown in FIG. 4, compressor 255 is a four-cylinder compressor with two solenoid valves 118 and two plungers 116 configured to regulate the flow of refrigerant to all four cylinders 210, 212. As such, during unloading, the output of this compressor 255 could be varied from some capacity slightly above zero percent to one slightly below 100% of rated capacity. In this embodiment, both control valves 118 are variable unloading devices configured to be modulated, or cycled on and off, as required to achieve a desired operation condition, by the variable unloading controller 214 during operation of the compressors 255.

In a further embodiment, one of the control valves 118 is a variable unloading device configured to cycle on and off as necessary to modulate the capacity of the compressor 255 within relatively narrow limits, such that the refrigeration system 250 operates within a desired operating region, while the other of the control valves 118 is a fixed unloading device configured to remain either open or closed for an extended period of time. In this embodiment, both fixed and variable control valves 118 and plungers 116 (shown in FIG. 1) are identical. The only difference is the control exercised over these valves 118 by the variable unloading controller 214. When the fixed control valve 118 is in the off or closed position, the variable control valve 118 can modulate the compressor 255 capacity from some capacity slightly above zero percent to 50% of rated capacity. When the fixed control valve 118 is in the on or open position, the variable control valve 118 can modulate the compressor 255 capacity from 50% to 100% of rated capacity.

Thus, the variable unloading controller 214 can be configured to include programming for fixed plus variable unloading of a multiple-cylinder compressor 255. As such, the compressor 255 can make large capacity adjustments using the fixed unloading control valve 118, and precise capacity adjustments using the variable unloading control valve 118. The fixed unloading control valve 118 is configured to selectively shut off refrigerant flow to selected compressing elements to reduce the load capacity by corresponding load capacity portions represented by the selected compressing elements, while the variable control valve 118 is configured to be cycled as necessary to modulate refrigerant flow to selected compressing elements to trim load capacity of the compressor 255 by a fraction of the selected compressing element's total load capacity.

In yet another embodiment of the invention, the refrigeration system 250 has two six-cylinder compressors 255. As shown in FIG. 4, the compressor 255 has fifth and sixth cylinders 216 (shown in phantom), and a third solenoid valve 118 and plunger (shown in FIG. 1) to regulate the flow of refrigerant to fifth and sixth cylinders 216. As in the example above, during unloading by operation of the variable unloading controller 214, the output of this compressor 255 could be varied from some capacity slightly above zero percent to slightly below 100% of rated capacity. As with the four-cylinder compressor described above, the six-cylinder compressor 255 can include both fixed and variable unloading solenoid valves 118. The embodiment of FIG. 4 may include a compressor with two fixed unloading solenoid valves 118 and one variable unloading solenoid valve 118, or one fixed unloading solenoid valves 118 and two variable unloading solenoid valve 118. As such, there are a number of possible variations wherein the fixed unloading solenoid valves 118 adjust the capacity of the compressor 255 in 33% steps and where the variable unloading solenoid valves 118 provide fine, incremental capacity adjustments.

Figure 5:
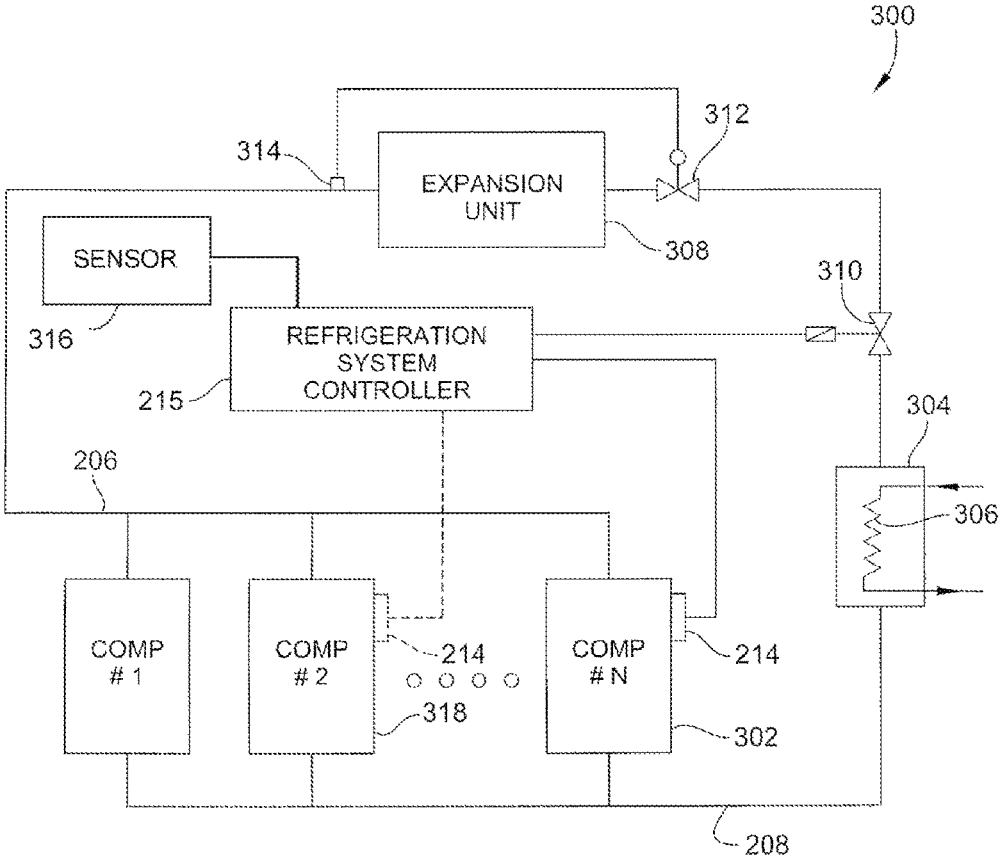
FIG. 5 is a schematic diagram of a multiple-compressor refrigeration system constructed in accordance with an embodiment of the invention.

In the various embodiments of the invention described above, the solenoid valve 118 is controlled by a variable unloading controller. FIG. 5 provides a schematic illustration of a multiple-compressor refrigeration system 300 having N compressors. The N compressors of refrigeration system 300 are connected in a parallel circuit having inlet flow line 206 that supplies a flow of refrigerant to the N compressors, and outlet flow line 208 that carries compressed refrigerant away from the N compressors. The outlet flow line 208 supplies a flow of refrigerant to a condenser 304. In a particular embodiment, the condenser 304 includes a fluid flow heat exchanger 306 (e.g. air or a liquid coolant) which provides a flow across the condenser 304 to cool and thereby condense the compressed, high-pressure refrigerant.

An expansion unit 308 to provide cooling is also arranged in fluid series downstream of the condenser 304. In an alternate embodiment, the condenser 304 may feed multiple expansion units arranged in parallel. In the embodiment of FIG. 5, the expansion unit 308 includes an on/off stop valve 310, controlled by the refrigeration system controller 215 to allow for operation of the expansion unit 308 to produce cooling when necessitated by a demand load on the refrigeration system 300, or to preclude operation of the expansion unit 308 when there is no such demand. The expansion unit 308 also includes an expansion valve 312 that may be responsive to, or in part controlled by, a downstream pressure of the expansion unit 308, sensed at location 314. The expansion valve 312 is configured to control the discharge of refrigerant into the expansion unit 308, wherein due to the expansion, heat is absorbed to expand the refrigerant to a gaseous state thereby creating a cooling/refrigeration effect at the expansion unit 308. The expansion unit 308 returns the expanded refrigerant in a gaseous state along the inlet flow line 206 to the bank of N reciprocating compressors.

In an embodiment of the invention, all N compressors in refrigeration system 300 have a plurality of cylinders. In at least one embodiment of the invention, one compressor serves as a trim compressor 302 having one or more solenoid valves 118 and plungers 116 (shown in FIG. 1) configured to regulate the flow of refrigerant to fewer than all of the plurality of cylinders. The trim compressor 302 includes the variable unloading controller 214, which is coupled to a refrigeration system controller 215. In embodiments of the invention, the trim compressor 302 is the first compressor in the refrigeration system 300 to turn on and the last compressor to turn off. Practically, with respect to many commercial and industrial refrigeration systems, it is contemplated that the trim compressor would operate continuously.

The variable unloading controller 214, which in at least one embodiment is an off-the-shelf programmable logic controller (PLC), is coupled to one or more solenoid valves 118 on the trim compressor 302 to regulate the flow of refrigerant to fewer than all of the cylinders in the trim compressor 302 in order to modulate the capacity of the trim compressor 302, and therefore, modulate the capacity of the refrigeration system 300. In at least one embodiment, the refrigeration system controller 215 generates a control signal to modulate the capacity of the refrigeration system 300. In particular embodiments, this control signal is an analog control signal. In some refrigeration systems, this analog control signal is generated in response to input from one or more sensors (e.g., temperature sensors, pressure sensors) that provide some indication of the load being placed on the refrigeration system.

In the embodiment of FIG. 5, the refrigeration system controller 215 is coupled to a sensor 316. The sensor 316 could be a pressure sensor configured to sense the suction pressure in the refrigeration system 300, or in an alternate embodiment, sensor 316 could be a temperature sensor located in the storage compartments being cooled by the refrigeration system 300. In particular embodiments, the refrigeration system controller 215 uses the data from sensor 316 to determine the voltage or current level of the analog control signal. Further, in some conventional refrigeration systems, this analog control signal operates to increase or decrease the speed of the compressor motors in order to modulate the capacity of the system.

However, in a particular embodiment of the invention, the variable unloading controller 214 is configured to convert the analog control signals from the refrigeration system controller 215 into ON/OFF (i.e., open/close) control signals to operate the one or more solenoid valves 118 on the trim compressor 302. In an embodiment, the variable unloading controller 214 is configured to cycle the solenoid valves 118 based on a voltage level of the analog control signal. For example, when the trim compressor 302 is to be unloaded, the variable unloading controller 214 causes the solenoid valve 118 to close until the voltage level of the analog control signal indicates that the solenoid valve 118 should be opened.

In a particular embodiment, the variable unloading controller 214 is configured to accept a variable analog control signal from the refrigeration system controller 215 that ranges from zero to 10 volts, for example. To accommodate various types of refrigeration system controllers 215, in alternate embodiments of the invention, the variable unloading controller 214 is configured to accept a variable analog control signal from the refrigeration system controller 215 whose current ranges from 4 milliamps (mA) to 20 mA, for example.

However, in alternate embodiments of the invention, the variable unloading controller 214 and the refrigeration system controller 215 could be configured to work with a variety of ranges for the analog control signal voltage levels other than zero volts to 10 volts, or for ranges of current levels other than 4 mA to 20 mA, where the ranges may be either greater or lesser than those provided in the example above.

In a particular embodiment of the invention, in which the analog control signal has a range of zero volts to 10 volts, the refrigeration system 300 may include a variable unloading controller 214 coupled to the trim compressors 302, and programmed to cycle the control valve 118 whenever the voltage level of the analog control signal crosses a 4-volt threshold level, or a 6-volt threshold level. For example, if the load on the refrigeration system 300 is such that the output of the compressors in the refrigeration system can be reduced to save energy and reduce operating costs, the refrigeration system controller 215 would generate an analog control signal of less than four volts, causing the variable unloading controller 214 to close the control valve 118.

At some point, the load on the refrigeration system 300 will increase, or the refrigeration system sensors will indicate the need for increased refrigeration system 300 output. This will cause the refrigeration system controller 215 to generate an analog control signal of more than six volts, causing the variable unloading controller 214 to open the control valve 118. In this embodiment, when the analog control signal voltage is between four and six volts, no cycling of the control valve 118 occurs. In this manner, the variable unloading controller 214 can continuously vary the capacity of the trim compressor 302 to modulate the capacity of the refrigeration system 300. Of course, the variable unloading controller 214 could just as easily be programmed to open the control valve 118 when the analog control signal is less than four volts, and close the control valve 118 when the analog control signal is more than six volts. It should be understood that the four-volt and six-volt threshold levels are exemplary. The threshold levels can be set any level within the range of the analog control signal. Further, as implied above, the variable unloading controller 214 can be programmed to take a particular action, or perform a particular function, when a threshold level is crossed in either direction.

The variable unloading controller 214 can continue operation of the trim compressor 302 in this fashion—cycling the control valve 118 whenever the analog control signal crosses the 4-volt, or 6-volt threshold. However, to prevent overcycling of the control valve 118 which could lead to frequent replacement of the solenoid components therein, in an embodiment of the invention, in a particular embodiment, the variable unloading controller 214 is programmed to implement a minimum delay time between transitions of the solenoid valve 118 between open and closed positions. In particular embodiments of the invention, the minimum delay time could be as few as 5 seconds or as great as 40 seconds, or possibly longer. However, it should be noted that in particular embodiments of the invention, the variable unloading controller can be programmed to operate without a minimum delay time. A suitably stable refrigeration system, in which the analog control signal does not change rapidly, may operate without a minimum delay time. In this case, the control valve 118 will change states whenever the analog control signal crosses the threshold voltage (or current) level.

However, in systems where the variable unloading controller 214 has been programmed to implement such a minimum delay time, the shorter the minimum delay time, the more quickly the trim compressor 302 can respond to the demands of the refrigeration system controller 215, while a longer minimum delay time is generally seen as providing a longer lifetime for the solenoid valve 118. In a particular embodiment, the variable unloading controller 214 is programmed to implement a minimum delay time of 20 seconds, while in alternate embodiments, the variable unloading controller 214 is programmed to implement a minimum delay time of 10 seconds or 30 seconds. But, it is also contemplated that refrigeration systems with variable unloading controllers 214 having minimum delay times less than five seconds or greater than one minute could be employed.

For example, consider an embodiment where the minimum delay time is 20 seconds, and the analog control signal range is zero to 10 volts wherein the variable unloading controller 214 is programmed to cycle the solenoid valve 118 when the analog control signal crosses the 4-volt threshold or 6-volt threshold. If the analog control signal goes from less than four volts to 6.5 volts, causing the variable unloading controller 214 to open the solenoid valve 118, then five seconds later the analog control signal voltage drops to 3.5 volts, the variable unloading controller 214 will wait 15 seconds before cycling the solenoid valve 118 to the closed position. Once closed, the solenoid valve 118 will remain closed for at least 20 seconds before it can be cycled to the open position.

In an alternate embodiment of the invention, in which the analog control signal has a range of four mA to 20 mA, the refrigeration system 300 may include a variable unloading controller 214 coupled to the trim compressors 302, and programmed to cycle the control valve 118 whenever the current level of the analog control signal crosses a 9-mA threshold level, or a 12-mA threshold level. For example, if the load on the refrigeration system 300 is such that the output of the compressors in the refrigeration system can be reduced to save energy and reduce operating costs, the refrigeration system controller 215 would generate an analog control signal of less than 9 mA, causing the variable unloading controller 214 to close the control valve 118.

At some point, the load on the refrigeration system 300 will increase, or the refrigeration system sensors will indicate the need for increased refrigeration system 300 output. This will cause the refrigeration system controller 215 to generate an analog control signal of more than 12 mA, causing the variable unloading controller 214 to open the control valve 118. In this embodiment, when the analog control signal current is between 9 mA and 12 mA, no cycling of the control valve 118 occurs. In this manner, the variable unloading controller 214 can continuously vary the capacity of the trim compressor 302 to modulate the capacity of the refrigeration system 300. Of course, the variable unloading controller 214 could just as easily be programmed to open the control valve 118 when the analog control signal is less than 9 mA, and close the control valve 118 when the analog control signal is more than 12 mA. As in the exemplary system described above, it should be understood that the 9 mA and 12 mA threshold levels are exemplary. The threshold levels can be set any level within the range of the analog control signal. Further, as implied above, the variable unloading controller 214 can be programmed to take a particular action, or perform a particular function, when a threshold level is crossed in either direction.

As with the previous example, the variable unloading controller 214 can continue operation of the trim compressor 302 in this fashion—cycling the control valve 118 whenever the analog control signal crosses the 9-mA, or 12-mA threshold. For example, if the minimum delay time is 20 seconds, and the analog control signal range is four to 20 mA wherein the variable unloading controller 214 is programmed to cycle the solenoid valve 118 when the analog control signal crosses the 9-mA threshold or 12-mA threshold. If the analog control signal goes from less than 9 mA to 13 mA, causing the variable unloading controller 214 to open the solenoid valve 118, then five seconds later the analog control signal current drops to 8 mA, the variable unloading controller 214 will wait 15 seconds before cycling the solenoid valve 118 to the closed position. Once closed, the solenoid valve 118 will remain closed for at least 20 seconds before it can be cycled to the open position.

While, in particular embodiments of the invention, there is a minimum delay time between transitions of the solenoid valve 118, typically, there is no maximum dwell time for the solenoid valve 118 once a transition has been executed. This means that when the trim compressor 302 is loading, embodiments of the variable unloading controller 214 will keep the solenoid valve in the open position until the refrigeration system controller 215 indicates, via the analog control signal, that the output of the refrigeration system 300 needs to be reduced. For example, where the analog control signal level has fallen below four volts in certain cases, or 9 mA in other cases, per the previous example, the variable unloading controller 214 would cause the solenoid valve 118 to close, wherein the valve 118 would remain closed, unloading the trim compressor 302, until the refrigeration system controller 215 determines that the output of the refrigeration system needs to increase.

While embodiments of the invention have no maximum dwell time, certain embodiments do have a minimum dwell time for the analog control signal. That is, the variable unloading controller 214 will be programmed to change the state of the control valve 118 only if the analog control signal crosses the threshold value and does not cross the threshold value again for the minimum dwell time. If the analog control signal does cross the threshold value before the minimum dwell time, the control valve 118 will not change states. In this manner, a rapid fluctuation in the analog control signal will prevent rapid cycling of control valve 118. In a particular embodiment, this approach is implemented by programming the variable unloading controller 214 to reset a clock each time the threshold value is crossed by the analog control signal. For example, the variable unloading controller 214 is programmed, in particular embodiments, to only cause the control valve 118 to change states when the analog control signal is on the appropriate side of the threshold value and the clock has reached the minimum dwell time.

For example, if the analog control signal voltage goes from below four volts to above six volts causing the solenoid valve 118 to open, as long as the voltage stays above six volts, the solenoid valve 118 will remain in the open position. Further, the solenoid valve 118 will remain in the open position as long as the analog control signal voltage is above four volts, because no cycling of the solenoid valve 118 occurs between the 4-volt and 6-volt thresholds. This example also applies in the case where the analog control signal voltage goes below four volts and the solenoid valve 118 cycles to the closed position. In this case, the solenoid valve will remain closed as long as the analog control signal voltage is below six volts. However, with a minimum dwell time of five seconds, for example, if the analog control signal goes from below four volts to above six volts for four seconds and back below four volts before five seconds, the solenoid valve 118 will not cycle remaining in the closed position.

In yet another embodiment of the invention, the solenoid valve 118 cycles based on the rate of change of the analog control signal. In an exemplary embodiment, the variable unloading controller 214 is programmed to unload the trim compressor 302 when the analog control signal voltage is less than two volts and to load the trim compressor 302 when the analog control signal voltage is greater than eight volts. Between two and eight volts, if the trim compressor 302 is unloading, the solenoid valve 118 would cycle to load the trim compressor 302 when the analog control signal voltage increases by more than 2.5 volts in three seconds, or passes above the 8-volt level. If the trim compressor 302 is loading, the solenoid valve 118 would cycle to unload the trim compressor 302 when the analog control signal voltage decreases by more than 2.5 volts in three seconds, or passes below the 2-volt level.

This particular embodiment may also include a minimum dwell time to prevent the solenoid valve 118 from cycling too frequently. Thus, if the minimum dwell time is 12 seconds, for example, the solenoid valve 118 will wait at least that long between successive cycles. As explained above, the minimum dwell time operates as a running clock that resets after each state change of the solenoid valve 118. Once the minimum dwell time has expired, per the example above, the solenoid valve 118, depending on its initial state, can change states if the analog control signal falls below the lower threshold (e.g., two volts), passes above the upper threshold (e.g. eight volts), or rises or falls by more than 2.5 volts in three seconds.

The ability of the variable unloading controller 214 to cycle the solenoid valve 118 to load or unload the trim compressor 302 as required to reach a desired operating condition, combined with the ability to regulate the flow of refrigerant to fewer than all of the cylinders in the trim compressor 302, provides an efficient and inexpensive way to maintain fairly precise control of refrigeration system 300 output within a defined range. The defined range is dependent on the number of cylinders in the trim compressor 302 and on the number of cylinders that include a solenoid valve 118 and plunger 116 to regulate the flow of refrigerant to that cylinder. For example, in a four-cylinder trim compressor 302 with one solenoid valve 118 and plunger 116 regulating the flow of refrigerant to two cylinders, the defined range is 50 percent. Specifically, the trim compressor 302 capacity from 50 to 100 percent can be modulated by the variable unloading controller 214.

Based on the example above, we can see that a similarly situated six-cylinder trim compressor 302, either 67 to 100 percent of capacity, or 33 to 100 percent of capacity could be modulated by the variable unloading controller 214, depending on whether the trim compressor 302 had one solenoid valve 118 and plunger 116 regulating the flow of refrigerant two cylinders or four cylinders or two one solenoid valves 118 and plungers 116 regulating the flow of refrigerant to four cylinders. Similarly, in a similarly situated eight-cylinder trim compressor 302, 75 to 100 percent, 50 to 100 percent, or 25 to 100 percent of capacity could be regulated by the variable unloading controller 214, depending on whether the trim compressor 302 had one, two or three solenoid valves 118 and plungers 116, each controlling the flow of refrigerant to two cylinders.

In the examples discussed above, only one compressor, the trim compressor 302, of the bank of compressors in refrigeration system 300 has its capacity modulated. This is an efficient and cost-effective method for adjusting the output of refrigeration system 300, as only the trim compressor includes solenoid valves 118 and plungers 116, and programming of the variable unloading controller 214 is somewhat simplified in that it only has to control the output of one compressor. This may be a satisfactory arrangement for those commercial or industrial refrigeration systems which run continuously near the maximum capacity of the system. When only marginal changes to the refrigeration system output are required, one trim compressor 302 may be suitable.

However, in refrigeration systems having a greater variation in the load placed on the system it may be desirable to have more than one trim compressor. Referring again to FIG. 5, a second variable unloading controller 214 (shown in phantom) is illustrated attached to a compressor 318 configured as a second trim compressor. The second variable unloading controller 214 is coupled to refrigeration system controller 215 and to one or more solenoid valves 118 and plungers 116 on second trim compressor 318. It is also envisioned that refrigeration systems having a third, fourth, or greater number of trim compressors could also be constructed in accordance with embodiments of the invention. In a particular embodiment of the invention, independent operation of the first and second variable unloading controllers 214 of trim compressors 302, 318 allows for precise control of refrigeration system 300 output over a larger system output range than would be possible with only one trim compressor 302.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A variable-capacity compressor comprising:

a housing having an inlet for receipt of refrigerant and an outlet for return of refrigerant;

a plurality of compressing elements contained in the housing between the inlet and the outlet;

at least one valve having an electrical control, the at least one valve being dedicated to one or more compressing elements, the one or more compressing elements being fewer than all of the plurality of compressing elements, the at least one valve being movable between a first state, in which the at least one valve is open to communicate a refrigerant flow to the compressing elements, and a second state, in which the at least one valve is closed to reduce the refrigerant flow to the compressing elements relative to the first state; and an unloading controller programmed to implement a first operational modulation mode to switch the at least one valve between first and second states in response to commands from a refrigeration system controller, and further configured to implement a second operational modulation mode to cycle the at least one valve a plurality of times between the first and second states to provide a portion of a capacity represented by the at least one valve's one or more compressing elements;

wherein the commands from the refrigeration system controller are transmitted in a form of an analog control signal, and wherein transitions between the first and second states are determined by the analog control signal.

2. The variable-capacity compressor of claim 1, wherein the unloading controller is further programmed to provide a minimum delay time for transitions between the first and second states, but no maximum dwell time for transitions between the first and second states.

3. The variable-capacity compressor of claim 2, wherein the minimum delay time ranges from 5 to 40 seconds.

4. The variable-capacity compressor of claim 1, wherein a voltage level or a current level of the analog control signal has a predetermined range, and wherein the at least one valve is commanded to change between the first and second states based on variations in the voltage level or the current level of the analog control signal.

5. The variable-capacity compressor of claim 4, wherein the voltage level of the analog control signal ranges from a minimum voltage to a maximum voltage, and wherein the unloading controller is programmed to cause the at least one valve to dwell in, or cycle to, one of the first and second states when the voltage level of the analog control signal is less than a threshold low voltage, and to cause the at least one valve to dwell in, or cycle to, the other of the first and second states when the voltage level of the analog control signal is greater than a threshold high voltage;

wherein the threshold high voltage is greater than the threshold low voltage, and wherein the threshold high voltage and the threshold low voltage are both greater than the minimum voltage, and both are less than the maximum voltage; and wherein the at least one valve does not change its state when the voltage level of the analog control signal is between the threshold low voltage and the threshold high voltage.

6. The variable-capacity compressor of claim 4, wherein the current level of the analog control signal ranges from a minimum current to a maximum current, and wherein the unloading controller is programmed to cause the at least one valve to dwell in, or cycle to, one of the first and second states when the current level of the analog control signal is less than a threshold low current, and to cause the at least one valve to dwell in, or cycle to, the other of the first and second states when the current level of the analog control signal is greater than a threshold high current;

wherein the threshold high current is greater than the threshold low current, and wherein the threshold high current and the threshold low current are both greater than the minimum current, and both are less than the maximum current; and wherein the at least one valve does not change its state when the current level of the analog control signal is between the threshold low current and the threshold high current.

7. The variable-capacity compressor of claim 4, wherein the variable-capacity compressor has a desired operating condition, and wherein the unloading controller, in response to the analog control signal, is programmed to vary, without limit, the amount of time the at least one valve dwells in the first or second state in order for the variable-capacity compressor to reach the desired operating condition.

8. The variable-capacity compressor of claim 7, further comprising a plurality of dedicated valves, wherein each of the plurality of dedicated valves is controlled by the unloading controller.

9. The variable-capacity compressor of claim 4, wherein the unloading controller is further programmed to provide a minimum dwell time for the analog control signal, such that transitions between the first and second states only occur when the analog control signal, after crossing a threshold voltage or current level, does not cross the threshold level again for the minimum dwell time.

10. The variable-capacity compressor of claim 9, wherein the minimum dwell time ranges from three to seven seconds.

11. The variable-capacity compressor of claim 9, wherein the unloading controller is further programmed to reset a clock each time the analog control signal crosses the threshold voltage or current level.

12. The variable-capacity compressor of claim 4, wherein the unloading controller is programmed to cause the at least one valve to dwell in, or cycle to, one of the first and second states when the voltage level of the analog control signal is less than a threshold low voltage, and cause the at least one valve to dwell in, or cycle to, the other of the first and second states when the voltage level of the analog control signal is greater than a threshold high voltage.

13. The variable-capacity compressor of claim 12, wherein, when the voltage level of the analog control signal is between the low threshold voltage and the high threshold voltage, the unloading controller is programmed to cause the at least one valve to change between the first and second states based on a rate of change in the voltage level or current level of the analog control signal.

14. The variable-capacity compressor of claim 13, wherein, when the voltage level of the analog control signal is between the low threshold voltage and the high threshold voltage, the unloading controller is programmed to cause the at least one valve to remain closed or cycle from open to closed when the voltage level or current level of the analog control signal drops by a predetermined amount within a predetermined time period, and to cause the at least one valve to remain open or cycle from closed to open when the voltage level or current level of the analog control signal rises by the predetermined amount within the predetermined time period.

15. The variable-capacity compressor of claim 1, wherein the at least one valve is configured to control the refrigerant flow to more than one compressing elements.

16. The variable-capacity compressor of claim 1, further comprising a second valve which, in combination with the at least one valve, controls a flow of gas to fewer than all of the plurality of compressing elements.

17. The variable-capacity compressor of claim 1, wherein the at least one valve comprises a plunger and a solenoid configured to control movement of the plunger.

18. The variable-capacity compressor of claim 17, wherein the plunger is located in a flow path between a discharge chamber of the compressor and a suction chamber of the compressor.

19. The variable-capacity compressor of claim 17, wherein the unloading controller comprises a programmable logic controller (PLC) programmed to energize the solenoid in response to commands from the refrigeration system controller.

20. A refrigeration system comprising: a refrigeration circuit including an evaporator and a condenser;

a plurality of refrigerant compressors configured to circulate refrigerant through the refrigeration circuit, wherein the plurality of refrigerant compressors includes a trim compressor having a plurality of cylinders, in which refrigerant is compressed, and at least one control valve for regulating a refrigerant flow to fewer than all of the plurality of cylinders, the at least one control valve configured to transition between open and closed states, and located in a cylinder head of the trim compressor;

a refrigeration system controller configured to regulate a rate of total refrigerant output from the plurality of refrigerant compressors;

a variable unloading controller configured to receive a first control signal from the refrigeration system controller, and to transmit a second control signal to the at least one control valve to vary a rate of refrigerant output from the trim compressor;

wherein the first control signal from the refrigeration system controller is an analog control signal which varies according to a load placed on the refrigeration system, and wherein a voltage level or a current level of the first control signal varies within a predetermined range, and wherein the at least one control valve is commanded to change between the open and closed states based on variations in the voltage level or the current level of the first control signal.

21. The refrigeration system of claim 20, wherein the variable unloading controller is programmed to provide a minimum delay time between transitions between the open and closed states, but no maximum dwell time between transitions between the open and closed states.

22. The refrigeration system of claim 21, wherein the minimum delay time ranges from 10 to 30 seconds.

23. The refrigeration system of claim 20, wherein the voltage level of the first control signal ranges from a minimum voltage to a maximum voltage, and wherein the variable unloading controller is programmed to cause the at least one control valve to dwell in, or cycle to, one of the open and closed states when the voltage level of the first control signal is less than a threshold low voltage, and to cause the at least one control valve to dwell in, or cycle to, the other of the open and closed states when the voltage level of the first control signal is greater than a threshold high voltage;

wherein the threshold high voltage is greater than the threshold low voltage, and wherein the threshold high voltage and the threshold low voltage are both greater than the minimum voltage, and both are less than the maximum voltage.

24. The refrigeration system of claim 20, wherein the current level of the first control signal ranges from a minimum current to a maximum current, and wherein the variable unloading controller is programmed to cause the at least one control valve to dwell in, or cycle to, one of the open and closed states when the current level of the first control signal is less than a threshold low current, and to cause the at least one control valve to dwell in, or cycle to, the other of the open and closed states when the current level of the first control signal is greater than a threshold high current;

wherein the threshold high current is greater than the threshold low current, and wherein the threshold high current and the threshold low current are both greater than the minimum current, and both are less than the maximum current.

25. The refrigeration system of claim 20, wherein the unloading controller is programmed to cause the at least one control valve to dwell in, or cycle to, one of the first and second states when the voltage level of the first control signal is less than a threshold low voltage, and cause the at least one control valve to dwell in, or cycle to, the other of the first and second states when the voltage level of the first control signal is greater than a threshold high voltage;

wherein, when the voltage level of the first control signal is between the low threshold voltage and the high threshold voltage, the unloading controller is programmed to cause the at least one control valve to change states based on a rate of change in the voltage level or current level of the first control signal.

26. The variable-capacity compressor of claim 25, wherein, when the voltage level of the first control signal is between the low threshold voltage and the high threshold voltage, the unloading controller is programmed to cause the at least one control valve to remain closed, or cycle from open to closed, when the voltage level or current level of the first control signal drops by a predetermined amount within a predetermined time period, and to cause the at least one control valve to remain open, or cycle from closed to open, when the voltage level or current level of the first control signal rises by the predetermined amount within the predetermined time period.

27. The refrigeration system of claim 20, wherein the refrigeration system has a desired operating condition, and wherein the unloading controller, in response to the first control signal, is programmed to vary, without limit, the amount of time the at least one control valve dwells in the open or closed state in order for the refrigeration system to reach the desired operating condition.

28. The refrigeration system of claim 20, wherein the trim compressor includes a plurality of control valves configured to regulate the refrigerant flow to fewer than all of the plurality of cylinders.

29. The refrigeration system of claim 20, wherein the trim compressor includes six cylinders, and further includes either one or two control valves.

30. The refrigeration system of claim 20, wherein the trim compressor includes eight cylinders, and further includes either one, two, or three control valves.

31. The refrigeration system of claim 20, wherein the at least one control valve comprises a plunger and a solenoid configured to control a movement of the plunger.

32. The refrigeration system of claim 31, wherein the variable unloading controller comprises a PLC controller programmed to energize the solenoid in response to the first control signal from the refrigeration system controller.

33. The refrigeration system of claim 20, further comprising a second trim compressor having a second variable unloading controller and at least one control valve located in a cylinder head of the second trim compressor, wherein the second variable unloading controller is configured to transmit a third control signal to the at least one control valve for the second trim compressor to vary a rate of refrigerant output from the second trim compressor.

34. The refrigeration system of claim 33, wherein the variable unloading controller and the second variable unloading controller are configured to operate independently of each other.

* * * * *